US008122842B2

(12) United States Patent
Gisborne

(10) Patent No.: US 8,122,842 B2
(45) Date of Patent: Feb. 28, 2012

(54) RETRACTABLE BOAT ROOF

(75) Inventor: Montgomery Scott Gisborne, Brechin (CA)

(73) Assignee: Ray Hirani, Kitchener, Ontario (CA)

( * ) Notice: Subject to any disclaimer, the term of this patent is extended or adjusted under 35 U.S.C. 154(b) by 257 days.

(21) Appl. No.: 12/608,148

(22) Filed: Oct. 29, 2009

(65) Prior Publication Data

US 2011/0100286 A1 May 5, 2011

(51) Int. Cl.
*B63B 17/02* (2006.01)

(52) U.S. Cl. ..... 114/361

(58) Field of Classification Search ..... 114/361; 296/107.16–107.2, 108, 116, 117
See application file for complete search history.

(56) References Cited

U.S. PATENT DOCUMENTS

| | | | | |
|---|---|---|---|---|
| 3,213,821 | A * | 10/1965 | Godwin | 114/344 |
| D315,138 | S | 3/1991 | Simpkins et al. | |
| 5,016,558 | A | 5/1991 | Oehler | |
| 5,518,205 | A | 5/1996 | Wurst et al. | |
| 5,931,114 | A | 8/1999 | Bartholomew | |
| 6,000,353 | A | 12/1999 | De Leu | |
| 6,105,524 | A | 8/2000 | Dane | |
| 7,047,902 | B1 | 5/2006 | Little | |
| 2001/0006297 | A1 * | 7/2001 | Dintner et al. | 296/107.17 |

* cited by examiner

*Primary Examiner* — Edwin Swinhart
(74) *Attorney, Agent, or Firm* — Harris Beach PLLC; Neal L. Slifkin

(57) ABSTRACT

A retractable roof assembly for a boat is provided which can be moved from a deployed position above the deck of the boat to a retracted position closer to the deck of the boat. Pivoting struts support the roof and are caused to move by a motor or pair of motors. Rollers on two of the struts move along a cam surface and the cam surface is designed such that during movement of the roof, the roof remains substantially horizontal.

18 Claims, 10 Drawing Sheets

RETRACTABLE BOAT ROOF

TECHNICAL FIELD OF INVENTION

The present invention relates to watercraft. More particularly, the present invention relates to improvements in the roof structure of watercraft which allow for the deployment and retraction of the roof for easy storage and road transportation of the watercraft.

BACKGROUND OF THE INVENTION

Watercraft with retractable roofs are known. For example, U.S. Pat. No. 5,016,558, discloses a boat with a retractable roof. However, the retractable roof disclosed in this patent has several drawbacks. The roof is manually operated, which, for larger roofs could require considerable strength to operate. It is possible that the person operating the roof could be injured while moving the roof by trying to control its movement. Also, once the roof has been unlatched for movement from the deployed position to the retracted position, there is nothing preventing the rapid movement of the roof between the two positions. It is desirable to have a retractable roof which can be automatically moved between the deployed and the retracted positions. It is also desirable to have a retractable roof which can be moved automatically in a controlled motion, while remaining horizontal, between the deployed and retracted positions. It is also desirable to have a roof which covers only a portion of the boat deck when the roof is deployed so that a portion of the deck is in the sun and a portion is in the shade.

BRIEF SUMMARY OF THE INVENTION

The present invention includes a retractable roof assembly for a boat. As used herein roof refers to either a roof attached to a roof support structure, a roof with an integrated support structure, or a roof with sufficient structural integrity such that no support structure is needed. The retractable roof assembly preferably includes four struts pivotally attached to the boat. The struts are preferably attached to pivot anchors near the boat's deck which are supported by an internal framework. The roof is operatively attached to at least two of the four struts. The roof includes at least one cam surface. At least one of the struts preferably includes a roller attached to it which is adapted for movement along the cam surface. A motor or plurality of motors moves the roof such that the roof moves from a first position in which the roof is above the boat to a second position in which the roof is substantially closer to the boat. Preferably, when moving from the first (deployed) position to the second (retracted) position, the roof remains substantially horizontal. The motor can move the roof with a screw drive, a belt drive, a chain drive or other driving mechanism. Preferably, the assembly includes a second motor. The motors can be attached to guide members on the roof. Preferably, one or both of the guide members have cam surfaces. As will be described in more detail below, the cam surfaces allow for movement of the roof while maintaining the roof in a generally horizontal orientation. Alternatively, a curved slot can replace the cam surface to achieve the same result.

In some embodiments, the guide member includes a slot and a support bar is attached to the struts. The support member passes through the guide member such that the support bar moves within the slot as the roof moves between the first and second positions. It is also possible to include a second guide member. A second motor can be attached to the second guide member. The second guide member can also include a slot and the support bar can pass through the slot in the second guide member such that the support bar moves within the slot in the second guide member as the roof moves between the first and second positions.

The roof is preferably sized such that it does not extend along the entire length of the boat deck. In some embodiments, the roof covers less than eighty percent of the boat deck. The roof can leave a portion either a portion of the bow or a portion of the stern uncovered.

DETAILED DESCRIPTION OF THE PREFERRED EMBODIMENTS OF THE INVENTION

Figure 4A:
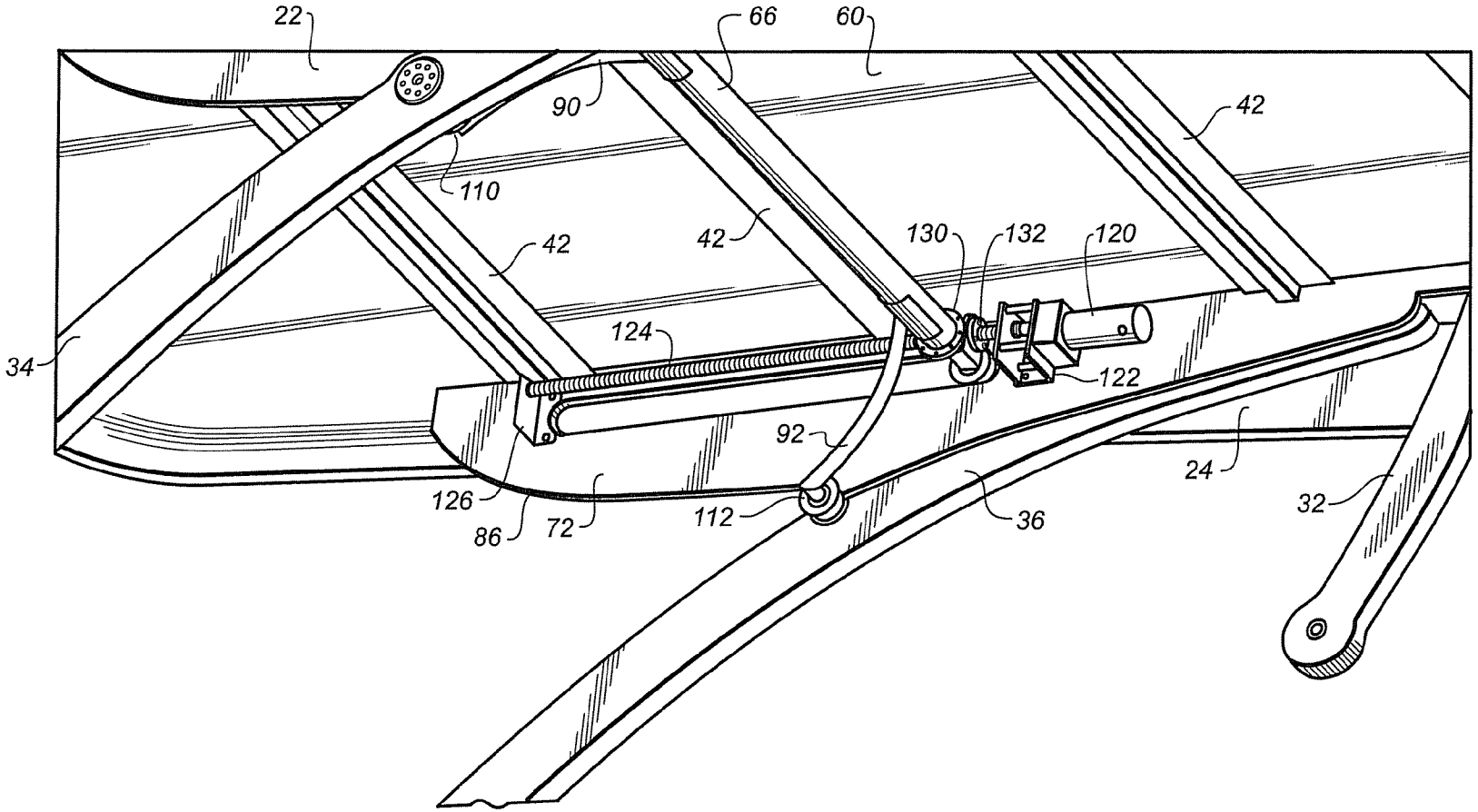
FIG. 4*a* is a perspective view of a portion of the embodiment of FIG. 1 showing the details of one motor used to move the roof.
Figure 4B:
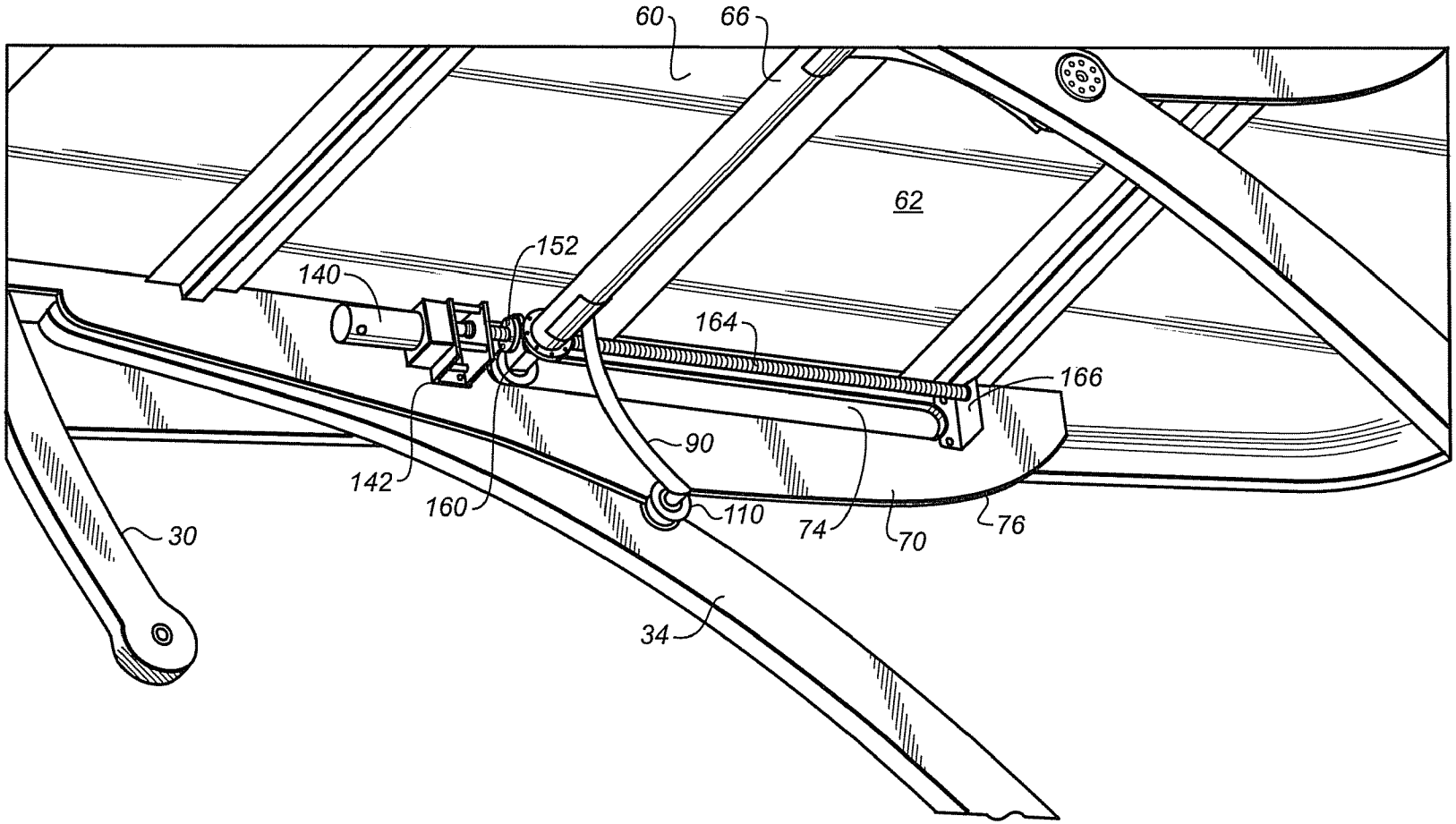
FIG. 4*b* is a perspective view of another portion of the embodiment of FIG. 1 showing the details of another motor used to move the roof.
Figure 4C:
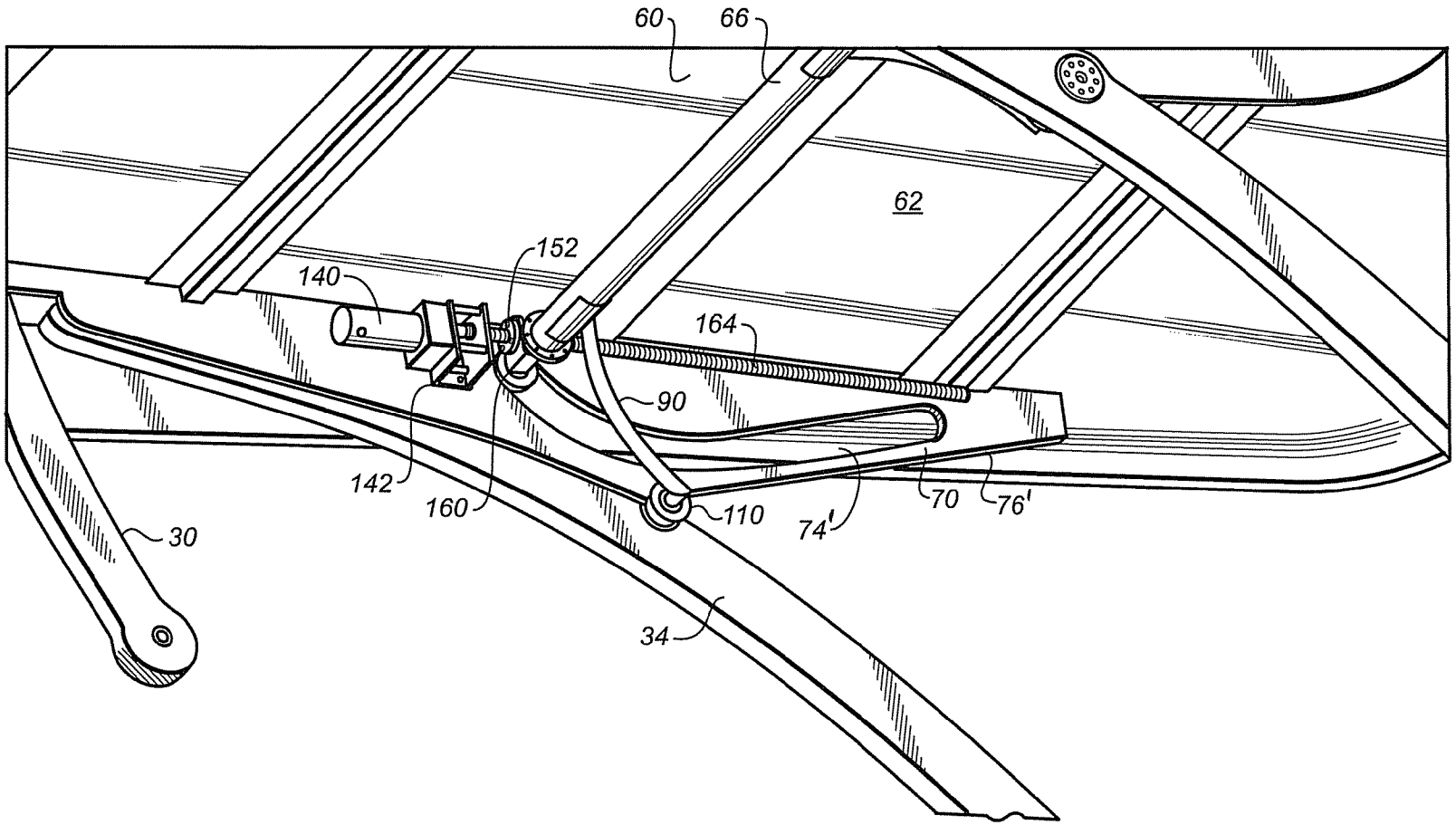
FIG. 4*c* is a perspective view of a portion of another embodiment of the present invention.
Figure 4D:
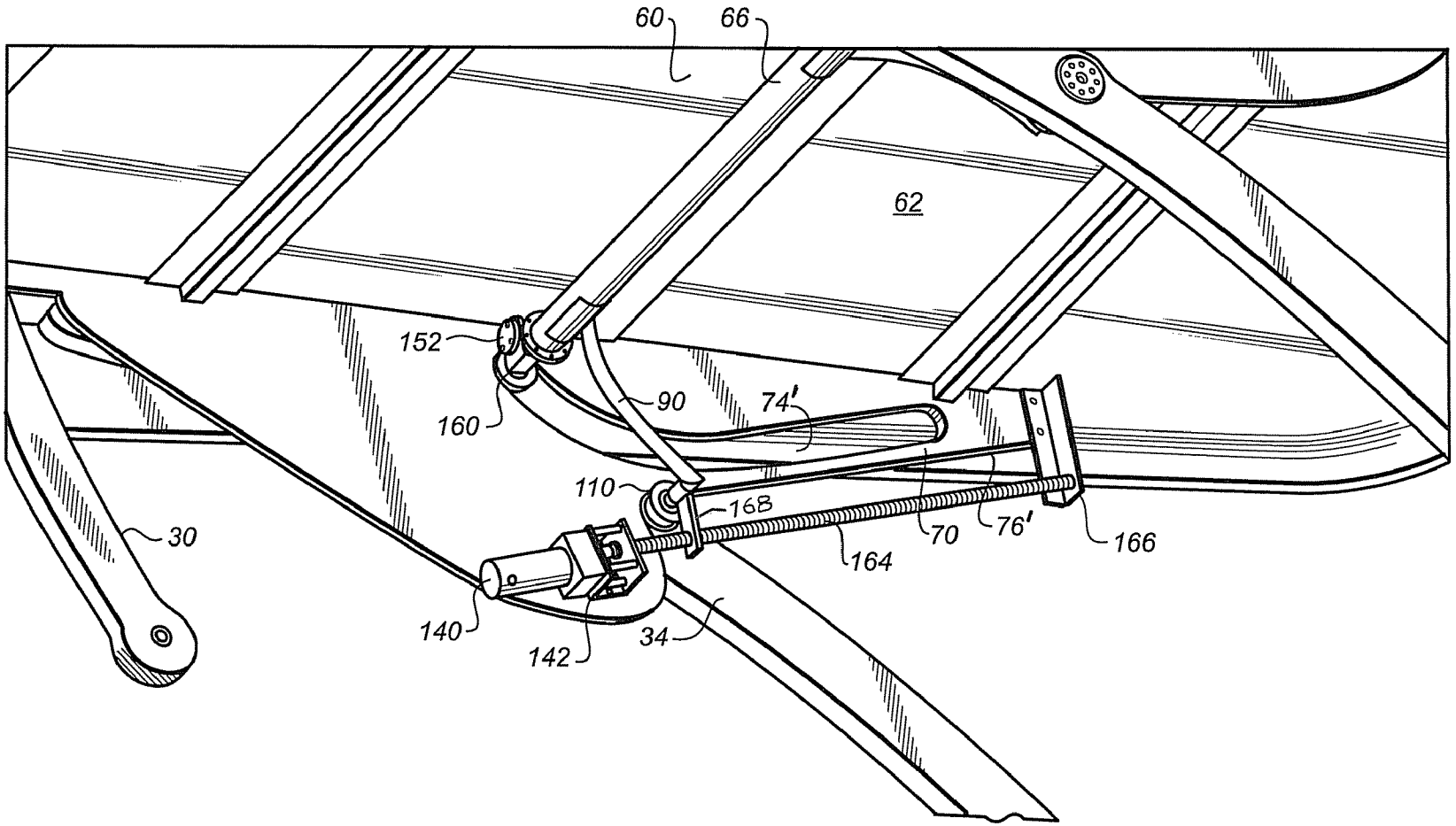
FIG. 4*d* is a perspective view of a portion of another embodiment of the present invention.
Figure 5:
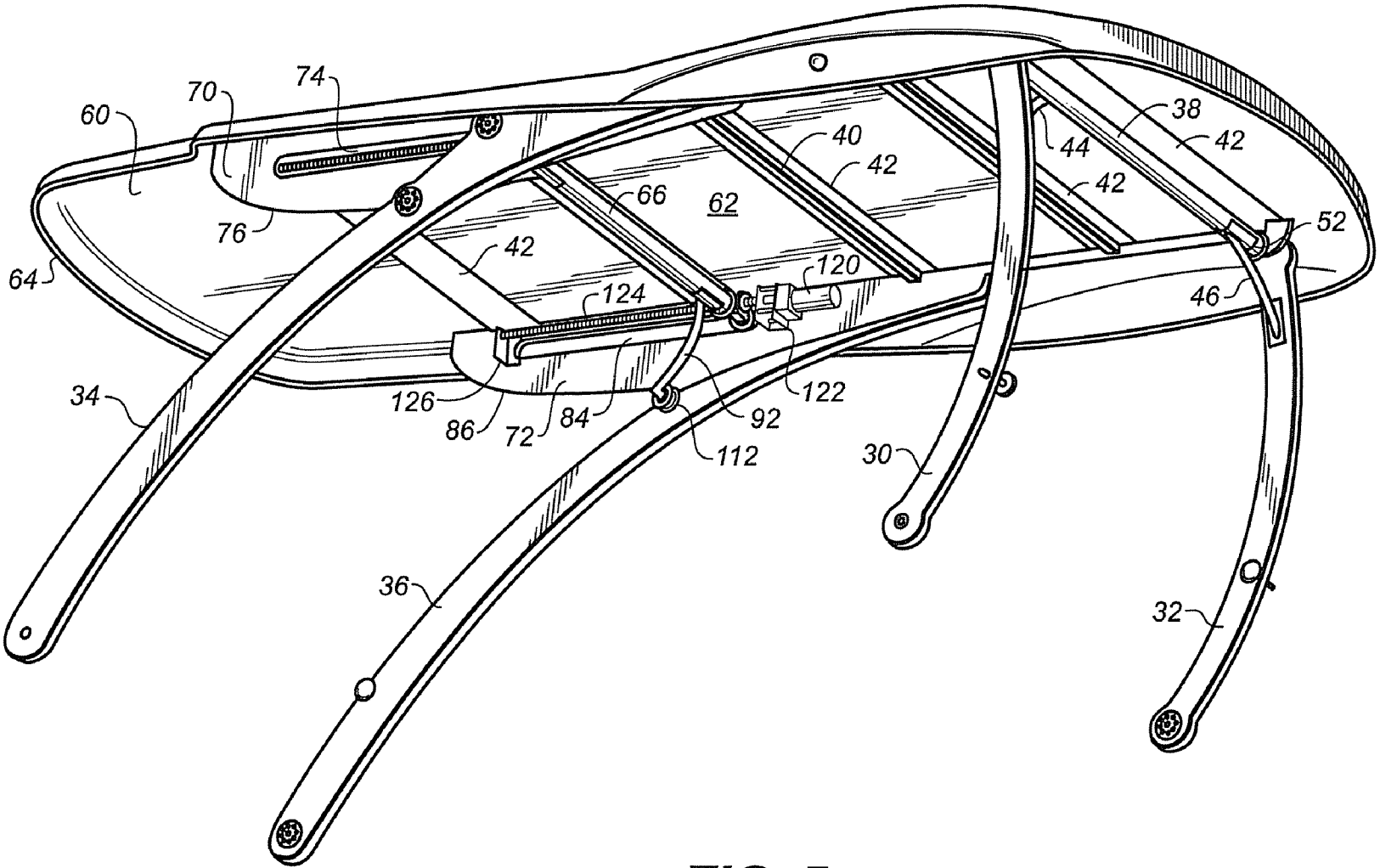
FIG. 5 is a perspective view of the embodiment of FIG. 1.
Figure 6:
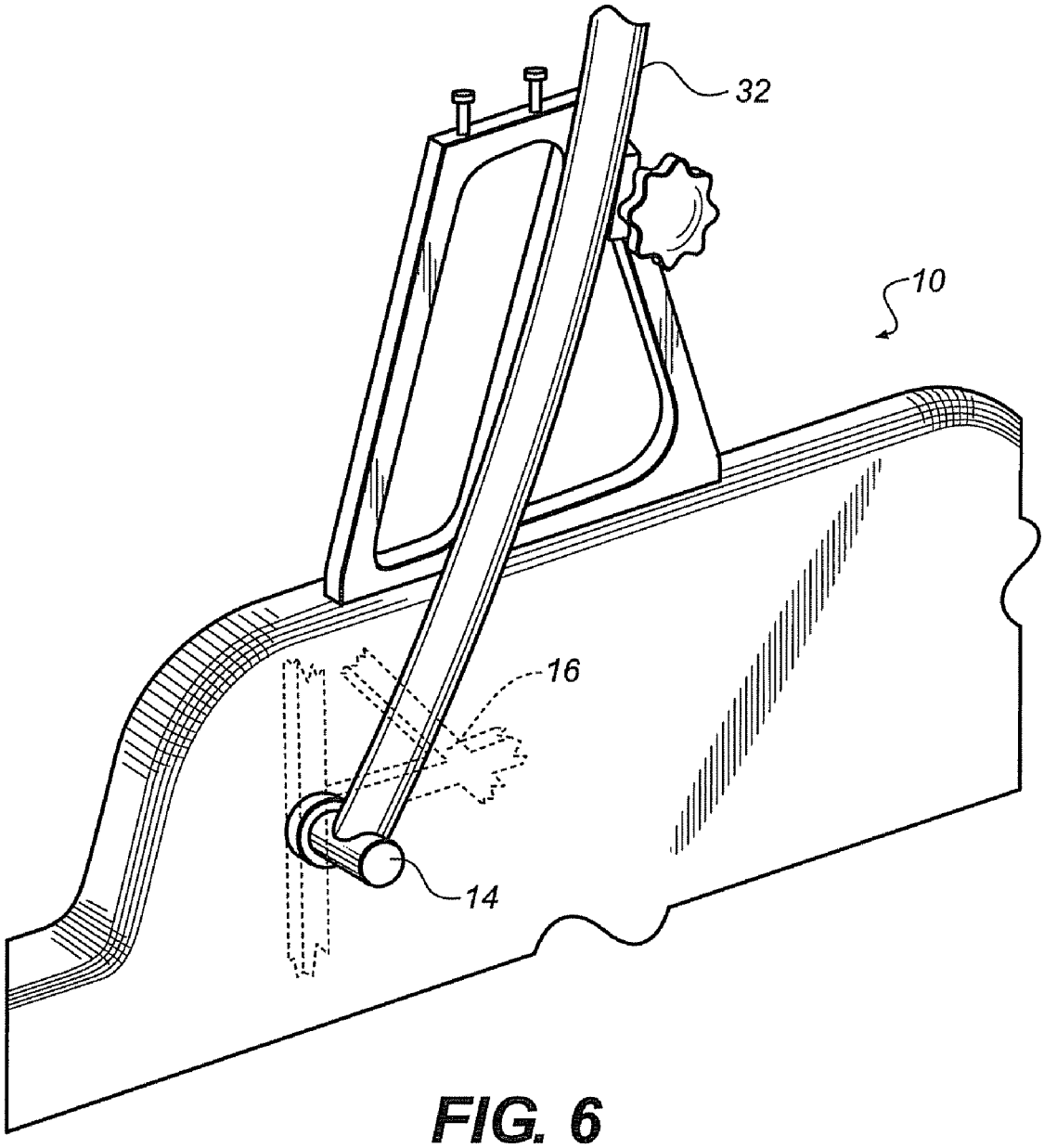
FIG. 6 is a perspective view of a portion of the embodiment of FIG. 1.
Figure 7:
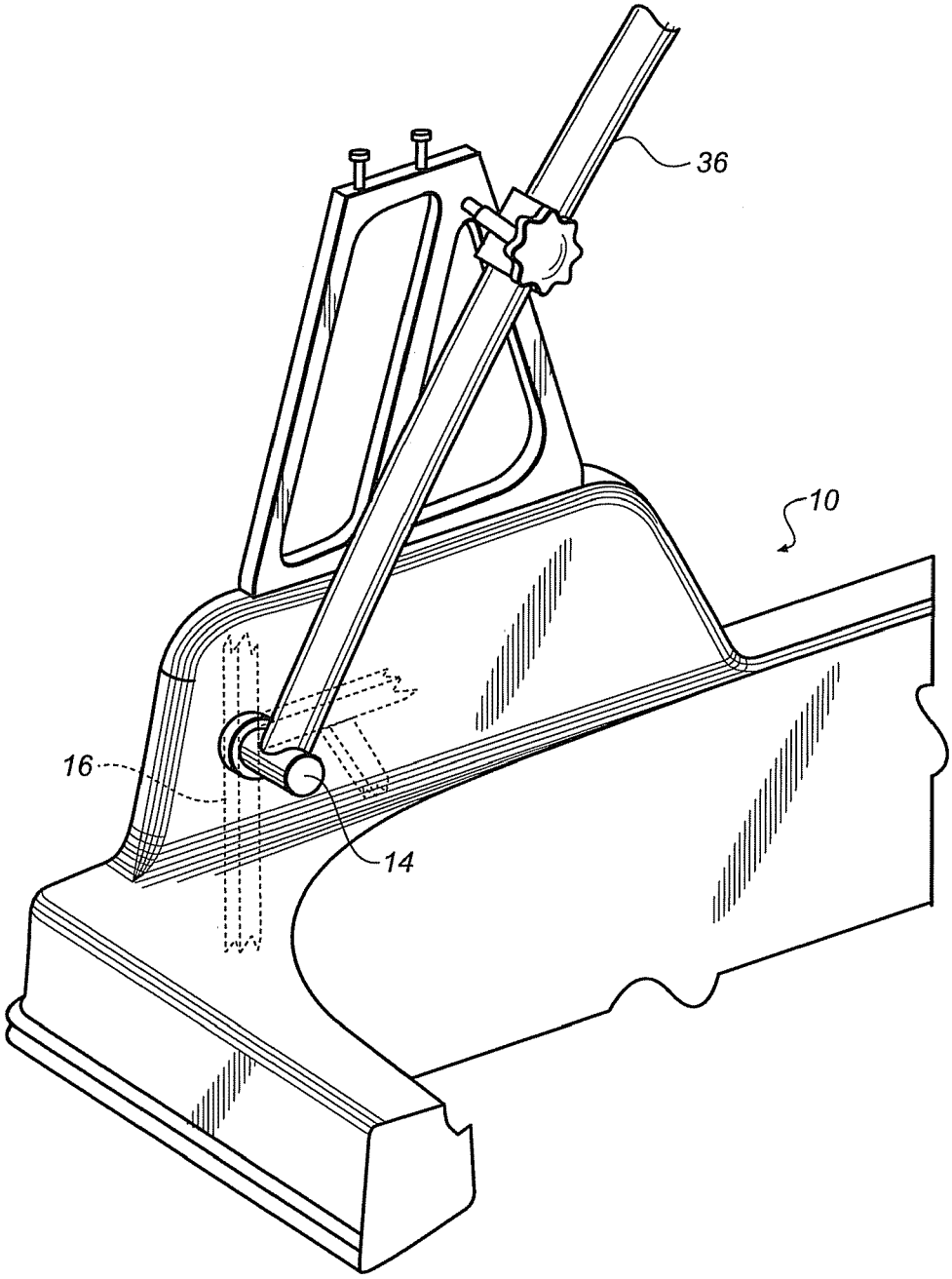
FIG. 7 is a perspective view of another portion of the embodiment of FIG. 1.

As illustrated in FIGS. 1-7, the retractable roof is shown in connection with a pontoon style boat. It will be understood by those of ordinary skill in the art that the retractable roof of the present invention can be used in connection with many other types of boats. Preferably, the boat 10 includes a deck 12 with four lower pivot anchors 14 (FIGS. 6 and 7, only two front shown) attached to the deck 12. Two front struts 30 and 32 are pivotally connected to pivot anchors 14 with pivot connections made in a conventional manner. The pivot anchors 14 are supported by internal framework 16 to support the weight of the struts 30 and 32. As shown in FIG. 5, the struts 30 and 32 are connected to one another through rod 38. Two rear struts 34 and 36 are pivotally connected with to pivot anchors 14 in a conventional manner. The struts 30, 32, 34 and 36 are preferably made from any suitable material such as fiber-reinforced plastic, thermoformed plastic, aluminum, or other suitable material. For structural rigidity, the struts 30, 32, 34 and 36 can have a metal tube core (not shown) surrounded by foam (not shown) with a fiber-reinforced plastic shell.

Preferably, a roof support structure 40 is provided with support members 42 (FIG. 5). The roof 60 is mounted on the roof support members 42; those of skill in the art will recognize that other structures are possible to support the roof 60. It is also possible to integrate the roof and support structure into a single structure. The roof 60 is preferably made from fiber-reinforced plastic, thermoformed plastic, aluminum or other suitable material. Preferably, the roof 60 and other structures of the boat 10 are made from material which will not deteriorate in the harsh conditions found on freshwater and saltwater marine environments.

In one embodiment, the front rod 38 extends into pivot attachments 52 (only one shown) in the roof support structure 40. The roof support structure 40 has two downwardly hanging guide members 70 and 72. Guide member 70 includes a slot 74 and a lower cam surface 76. Similarly, guide member 72 includes a slot 84 and a lower cam surface 86. The roof 60 includes a generally horizontal surface 62 and a downwardly extending peripheral lip 64. Preferably, support rods 44 and 46 extend between the front rod 38 and struts 30 and 32 respectively.

As best seen in FIGS. 4*a* and 4*b*, a guide rod 66 extends from the strut 34 on a first side 22 of the roof 60, through slot 74 and through slot 84, and to the strut 36 on the opposite side 24 of the roof 60. Support rods 90 and 92 extend from the guide rod 66 to struts 34 and 36, respectively. Rollers 110 and 112 are attached to struts 34 and 36, respectively.

As best seen in FIG. 4*a*, in one embodiment, a motor 120 is mounted to guide member 72 by mounting frame 122. A collar 130 surrounds guide rod 66 and includes a threaded ring 132. The motor 120 includes a screw 124 which is threaded inside of the ring 132. The screw 124 is rotationally supported by support 126. When the motor 120 turns the screw 124 the ring 132 moves toward and away from the motor 120 depending on the direction that the screw 124 is turning.

As best seen in FIG. 4*b*, in one embodiment, a second motor 140 includes a screw 164 supported by support 166. The second motor 140 is mounted to guide member 70 by mounting frame 142. Ring 152 is connected to collar 160 and the guide rod 66 moves with the ring 152. Because the struts 34 and 36 cannot move to the left as viewed in FIG. 1, movement of the guide rod 66 causes the roof 60 with the support structure 40 to move to the right as viewed in FIG. 2.

FIGS. 4*c* and 4*d* show another embodiment of the present invention. In this embodiment, the slot 74' is curved and the surface 76' is straight, but angled. In FIG. 4*c*, the motor 140 is attached by mounting frame 142 and has a screw drive 164 which moves collar 152 and causes the guide rod 66 to follow the curved path of the slot 74'. In FIG. 4*d*, the motor 140 and screw drive 164 act on the roller 110, through link 168, instead of the collar 160. The motor 140 and screw drive 164 can also act on the roller 110 in the embodiment of FIG. 4*a* in a manner similar to that shown in FIG. 4*d*.

Figure 1:
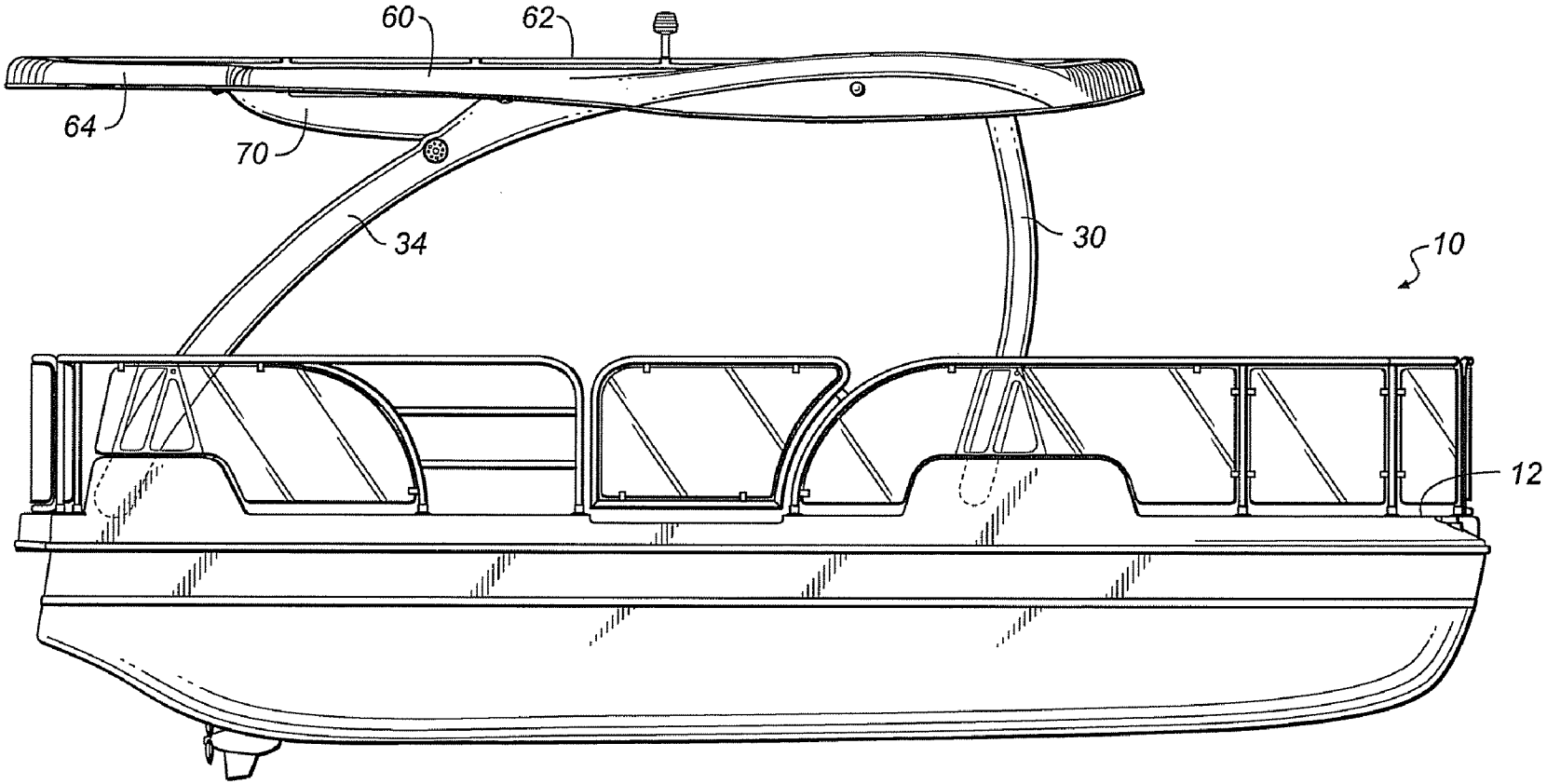
FIG. 1 is a side elevation view of one embodiment of the present invention.
Figure 2:
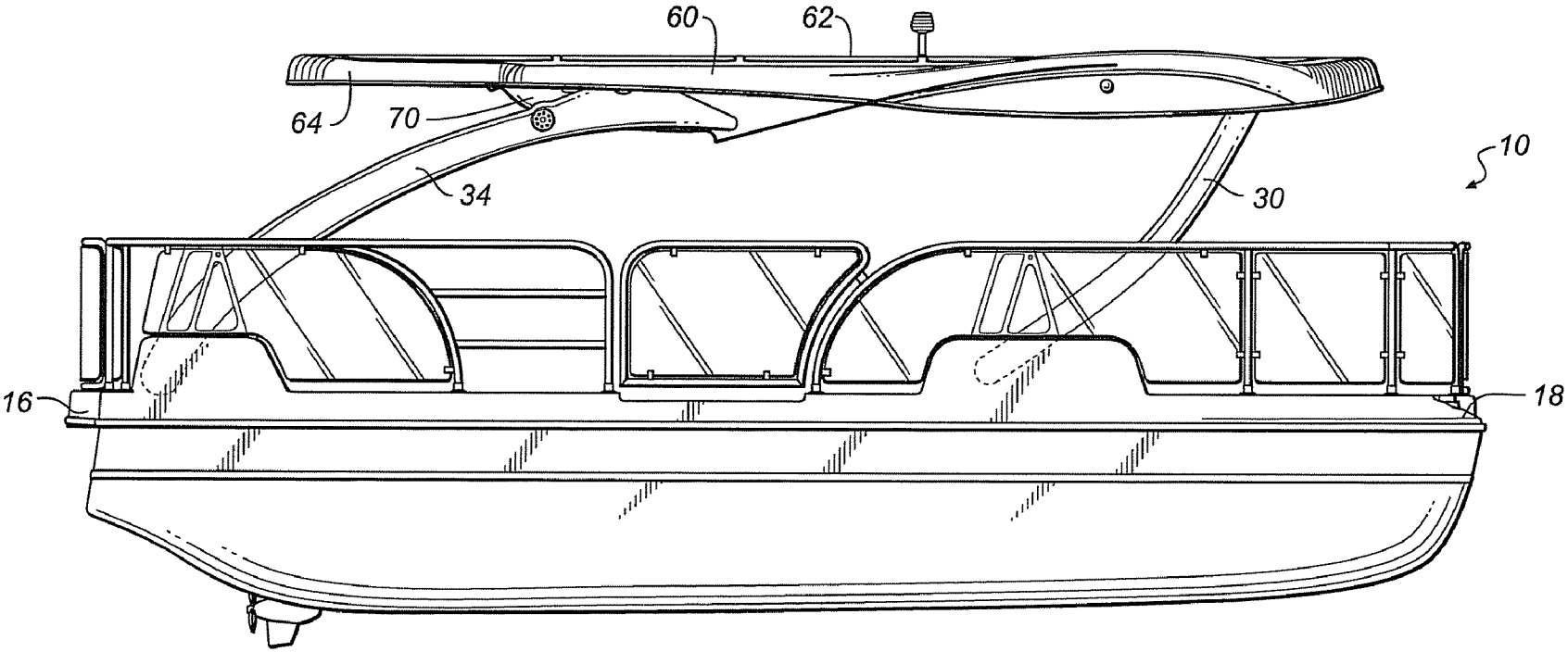
FIG. 2. is a side elevation view of the embodiment of FIG. 1 showing the roof partially retracted.
Figure 3:
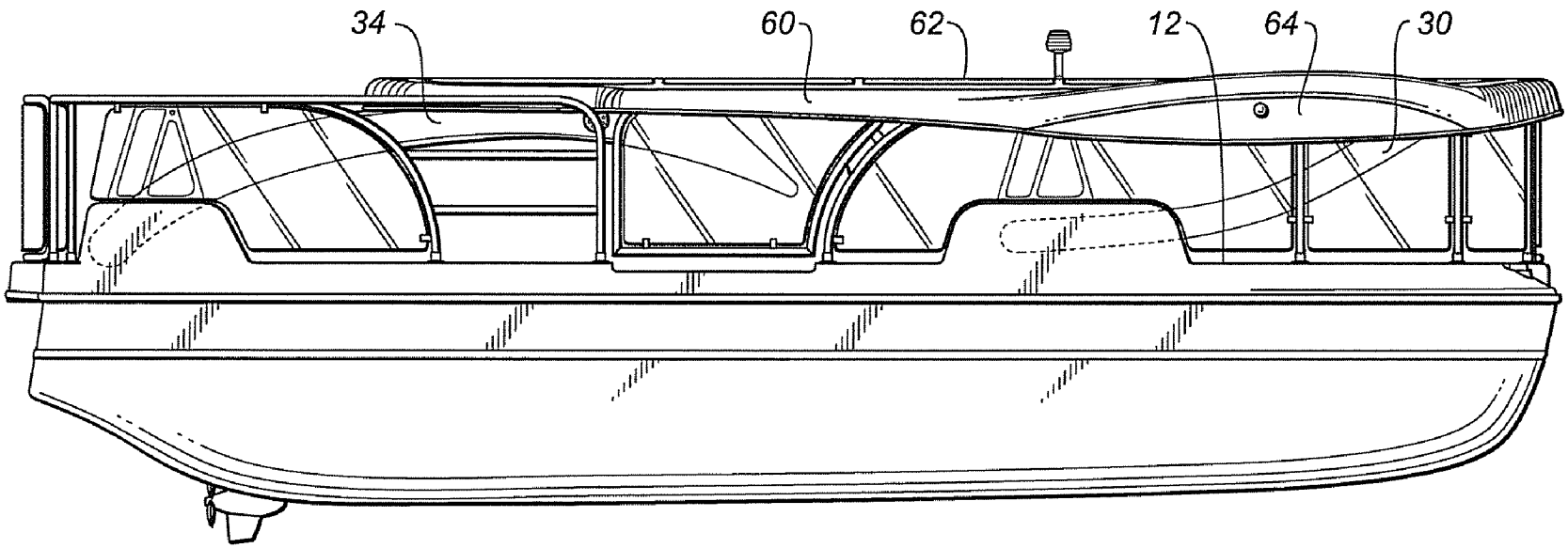
FIG. 3 is a side elevation view of the embodiment of FIG. 1 showing the roof fully retracted.

As the roof 60 moves, rollers 110 and 112 slide along cam surfaces 76 and 86, respectively. The curvature of cam surfaces 76 and 86 (FIGS. 4*a* and 4*b*) or the curvature of the slot 74' (FIGS. 4*c* and 4*d*) is designed such that in all positions of the roof 60, the roof is maintained in a substantially horizontal position. When the roof 60 moves from the deployed position as shown in FIG. 1, through the partially retracted position as shown in FIG. 2, to the retracted position as shown in FIG. 3, the struts 30, 32, 34 and 36 pivot downwardly and to the right as viewed in FIG. 2. In the retracted position, the roof 60 is closer to the boat deck 12 than when the roof 60 is in the deployed position. In the retracted position, the roof 60 covers a different portion of the boat deck 12 than when the roof is in the deployed position. It will be understood by those of ordinary skill in the art that the roof may be designed to cover different portions of the boat deck 12 than as shown in the figures. For example, in the deployed position, the roof can be covering primarily the aft section 16 of the boat 10 as shown in FIG. 1, or can be covering primarily the fore section 16 (not shown).

One of ordinary skill in the art will appreciate that there are many equally feasible physical arrangements of the various elements described. The foregoing description is meant to provide a conceptual overview and should not be viewed as limiting the invention. While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A retractable roof assembly for a boat having a deck, a bow and a stern, the retractable roof assembly comprising:
- first and second struts, pivotally attached to the boat;
- third and fourth struts pivotally attached to the boat;
- a roof operatively attached to the third and fourth struts;
- the roof having a cam surface;
- one of the first and second struts having a roller attached thereto adapted for movement along the cam surface;
- a motor operatively connected to the retractable roof assembly for moving the roof such that the roof moves from a first position in which the roof is above the boat to a second position in which the roof is substantially closer to the boat.

2. The retractable roof assembly of claim 1 in which during movement of the roof from the first position to the second position, the roof remains substantially horizontal.

3. The retractable roof assembly of claim 1 in which the motor is attached to the roof and includes a screw drive for moving the roof.

4. The retractable roof assembly of claim 1 further including a second motor for moving the roof.

5. The retractable roof assembly of claim 3 wherein the roof includes a guide member and the motor is attached to the guide member.

6. The retractable roof assembly of claim 5 wherein the cam surface is on the guide member.

7. The retractable roof assembly of claim 6 wherein the guide member includes a slot and further including a support bar attached to the first and second struts and passing through the guide member such that the support bar moves within the slot as the roof moves between the first and second positions.

8. The retractable roof assembly of claim 7 wherein the roof includes a second guide member and the second motor is attached to the second guide member.

9. The retractable roof assembly of claim 8 wherein the second guide member includes a slot and wherein the support bar passes through the slot in the second guide member such that the support bar moves within the slot in the second guide member as the roof moves between the first and second positions.

10. The retractable roof assembly of claim 9 wherein the second guide member includes a second cam surface.

11. The retractable roof assembly of claim 1 wherein the other of the first and second struts also include a roller attached thereto adapted for movement along a second cam surface.

12. The retractable roof assembly of claim 1 wherein the roof is sized such that it does not extend along the entire length of the boat deck.

13. The retractable roof assembly of claim 12 wherein the roof covers less than eighty percent of the boat deck.

14. The retractable roof assembly of claim 1 wherein when the roof is deployed, the roof does not cover a portion of the bow of the boat.

15. A retractable roof assembly for a boat having a deck, a bow and a stern, the retractable roof assembly comprising:
- first and second struts, pivotally attached to the boat;

third and fourth struts pivotally attached to the boat;

a roof operatively attached to the third and fourth struts;

the roof having a member attached thereto with a curved slot therein;

the first and second struts having a support bar attached thereto, the support bar passing through the curved slot;

a motor operatively connected to the retractable roof assembly for moving the roof such that the roof moves from a first position in which the roof is above the boat to a second position in which the roof is substantially closer to the boat and such that the roof remains intact along its entire length.

16. The retractable roof assembly of claim 15 in which during movement of the roof from the first position to the second position, the roof remains substantially horizontal.

17. The retractable roof assembly of claim 15 in which the motor is attached to the roof and includes a screw drive for moving the roof.

18. The retractable roof assembly of claim 15 further including a second motor for moving the roof.

* * * * *